US006428611B1

(12) United States Patent
Andolino et al.

(10) Patent No.: US 6,428,611 B1
(45) Date of Patent: Aug. 6, 2002

(54) APPARATUS FOR REMOVING MIST, SMOKE AND PARTICLES GENERATED BY MACHINE TOOLS

(76) Inventors: Anthony J. Andolino, 10901 133rd Cir., Champlin, MN (US) 55316; John A. Larson, 10152 Nathan La., Maple Grove, MN (US) 55369

( * ) Notice: Subject to any disclaimer, the term of this patent is extended or adjusted under 35 U.S.C. 154(b) by 0 days.

(21) Appl. No.: 09/721,725

(22) Filed: Nov. 27, 2000

(51) Int. Cl.[7] ..... B03C 3/68

(52) U.S. Cl. ..... 96/25; 55/DIG. 18; 96/57; 96/63; 96/82

(58) Field of Search ..... 96/18, 25, 55, 96/57, 58, 63, 80, 82; 323/903; 55/DIG. 18

(56) References Cited

U.S. PATENT DOCUMENTS

| | | | | | |
|---|---|---|---|---|---|
| 2,709,954 | A | * | 6/1955 | Baker | 96/57 X |
| 3,178,869 | A | * | 4/1965 | Cook | 96/58 |
| 3,299,620 | A | * | 1/1967 | Hollingworth | 96/57 X |
| 3,804,942 | A | * | 4/1974 | Kato et al. | 96/58 X |
| 4,163,650 | A | * | 8/1979 | Watson et al. | 96/57 |
| 4,261,712 | A | * | 4/1981 | Kinkade | 96/58 |
| 4,268,282 | A | * | 5/1981 | MacKenzie | 55/DIG. 18 |
| 4,376,642 | A | * | 3/1983 | Verity | 96/82 X |
| 4,921,509 | A | * | 5/1990 | Maclin | 96/57 X |
| 5,063,906 | A | * | 11/1991 | Rogers et al. | 96/57 X |
| 5,069,691 | A | * | 12/1991 | Travis et al. | 96/57 |
| 5,456,741 | A | * | 10/1995 | Takahara et al. | 96/57 X |
| 5,456,742 | A | * | 10/1995 | Glenn et al. | 96/82 X |
| 5,704,955 | A | * | 1/1998 | Giles | 96/55 X |
| 5,762,691 | A | * | 6/1998 | Gondar | 96/63 X |

FOREIGN PATENT DOCUMENTS

| | | | | |
|---|---|---|---|---|
| CA | 1127980 | * | 7/1982 | 96/57 |

* cited by examiner

*Primary Examiner*—Richard L. Chiesa
(74) *Attorney, Agent, or Firm*—Herman H. Bains

(57) ABSTRACT

A filter apparatus for use in removing mist, smoke and particles generated by a machine tool includes a mechanical first filtration stage and a second filtration stage consisting of an electrostatic precipitator. A blower device creates a stream of air for entraining and moving mist, smoke and other particles upwardly through the first and second filtration stages. Circuitry is provided selectively opening the circuit to the collector of the electrostatic precipitator. The collector is energized by a lower voltage from the ionizing field when current to the collector is interrupted. By energizing the collector of the electrostatic filter at a low voltage and by operating the blower unit at a low velocity, mist, smoke and other particles are efficiently collected without shorting the collector plates when water based metal working fluids are used.

8 Claims, 3 Drawing Sheets

APPARATUS FOR REMOVING MIST, SMOKE AND PARTICLES GENERATED BY MACHINE TOOLS

FIELD OF THE INVENTION

This invention relates to an apparatus for removing smoke, mist and other particles generated by machine tools during a machining operation.

BACKGROUND OF THE INVENTION

The advancements to computer numerical control machine tools such as higher spindle speed and high pressure coolant pumps have made an environment problem because the metal working fluid used to cool, remove chips and lubricate tooling creates a very fine mist.

Conventional mist collectors such as centrifugal collectors cannot filter this fine atomized mist without the use of expensive disposable media secondary filters. Other conventional collectors use disposable media filters as the primary filtration method. The problem with these disposable media filters is that they plug up as they collect mist so that the airflow declines each day of operation. The collected mist does not drain out of these filters so that you end up throwing out media filters that are saturated with metal working fluids.

It is well established that electrostatic precipitators work very well in mist applications when the metal working fluid is petroleum oil product. The collected oil mist droplets drain off. the electrostatic precipitator cell to be reclaimed and reused. Most conventional electrostatic precipitator units are large and are connected to several machine tools with ductwork. Most metal working fluids used today are a water-based or synthetic. These water-based metal working fluids can create nuisance arcing problems for electrostatic precipitation filtration because the collected mist shorts the collector section of the electrostatic precipitator, therefore, industry shies away from using electrostatic precipitators in the water-based mist applications.

SUMMARY OF THE INVENTION

An object of this invention is to provide a small compact air cleaner that can be directly mounted to a machine tool. Most conventional electrostatic precipitator units are large and are connected to several machine tools with ductwork. This small air cleaner includes 4" metal mesh impingers to capture the large mist droplets and a small electrostatic precipitator cell to capture the very fine mist, smoke and other particles. This new apparatus includes a variable speed controller so that the airflow can be set at the minimum airflow level that will provide negative pressure within the machine tool enclosure. The slower the air speed through an electrostatic precipitator increases the collection efficiency. Conventional mist collectors do not have speed control so that they end up collecting excessive amounts of mist out of the machine tool enclosure that prematurely plug filters or create excessive maintenance. The combination of the slower air speed through the electrostatic precipitator and the ability to reduce the voltage on the collector section of the electrostatic precipitator allows this new apparatus to effectively capture mist from machine tools that use water-based and synthetic metal working fluids without nuisance arcing that has previously, caused industry to shy away from using electrostatic precipitator technology.

DESCRIPTION OF THE PREFERRED EMBODIMENT

Figure 2:
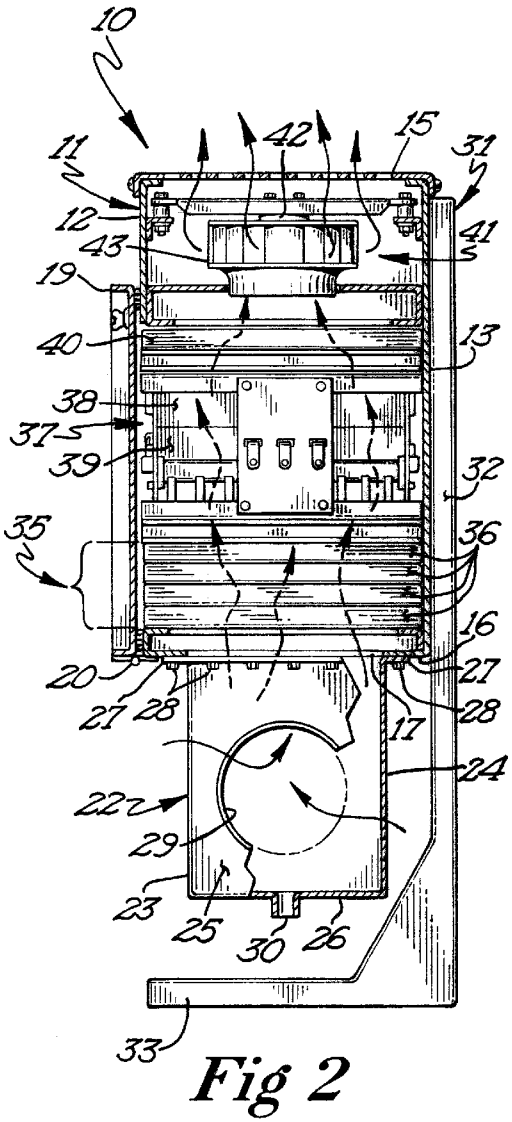
FIG. 2 is a cross-sectional view taken along line 2—2 of FIG. 1 and looking in the direction of the arrows.

Referring now to the drawings it will be seen that one embodiment of the novel apparatus, designated generally by the reference numeral 10, is thereshown. The apparatus 10 is used in conjunction with machine tools which use metal working fluids that create mist during the machining operation. The apparatus 10 collects and removes smoke, mist and other particles generated by the machine tools. Machine tools use either water based or petroleum metal working fluids during the machining operation.

Mist removing machines use both mechanical filters (usually aluminum mesh) and electrostatic precipitator for removing the smoke, mist and particles. Conventional electrostatic precipitator mist removing machines are able to remove mist, particles and smoke generated by petroleum based metal working fluids but the industry shies away from using electrostatic precipitators in water based mist applications. The water mist creates short circuits within the collection plates.

The novel apparatus 10 includes a generally rectangular housing 11 having a front wall 12, a rear wall 13, side walls 14 and a bottom wall 16. The housing also has a slotted or grill type top wall 15 which defines the outlet through which air passes. The bottom wall 16 has an opening 17 therein which defines an inlet. The front wall 12 has an opening 18 therein providing access to the components in the housing and door 19 connected to the housing by a hinge 20 is swingable between open and closed positions. Locks are provided for retaining the door 19 in a closed position.

A generally rectangular shaped plenum chamber 22 is secured to the bottom wall 16 of the housing 11 and depends therefrom. The plenum chamber 22 has a front wall 23, rear wall 24, side walls 25 and a bottom wall 26. The side, front and rear walls of the plenum chamber each has outturned flanges 27 having openings therein through which bolts 28 project for securing the plenum chamber to the bottom wall of the housing. The inlet opening 17 in the bottom wall of the housing is registering relation with the open top of the plenum chamber. One of the side walls 25 has a flanged inlet opening 29 therein which connects to a machine tool by means of a conduit. The bottom wall 26 of the plenum chamber has a drain 30 through which collected liquids may flow.

The apparatus 10 may be mounted on the machine tool by means of a machine tool mount stand 31 which has vertical legs 32 and horizontal mounting members 33 each being integrally formed with one of the legs 32. When the apparatus 10 is mounted directly on the machine tool, liquid collected during the filtering operation will flow downwardly through the housing into the plenum chamber and thereafter through the drain 30 to be returned to the machine tool (diagrammatically shown).

The filter apparatus 10 may also be mounted on a pedestal or it may be suspended overhead from the ceiling. These options allow use with a wide range of machine tools. The filter apparatus may also be mounted on a machine tool 34 by omitting the plenum chamber 22 and mounting the housing directly on the machine tool such that the outlet 17 communicates with the machine tool interior. Collected liquid will flow directly through the opening 17 into the machine tool 34.

The filter apparatus includes a first stage filtration system 35 positioned within the housing 11 and including a plurality of mechanical filters 36. In the embodiment shown, the filters 36 are mesh type aluminum filters and function as mechanical mist impingers for removing large mist droplets and particles. Each filter is of rectangular configuration and the filters are horizontally arranged one above the other. In the embodiment shown, four such filters are provided. The filters 36 are of substantially identical construction.

The filter apparatus 10 also includes an electrostatic precipitator 37 as a second stage filtration system. The electrostatic precipitator 37 includes an ionizer unit 38 and a collector unit 39. The electrostatic precipitator is horizontally disposed and positioned above the first stage filtration system.

Sub-micron droplets and particles remain after the mist, particles and smoke pass through the first filtration stage. The ionizer unit ionizes these incoming electrically neutral particles and droplets and these ionized particles and droplets are readily attracted to the collection plates of the collector. A mechanical filter 40 substantially identical to filters 36 is positioned above and adjacent the electrostatic precipitator 37.

Figure 1:
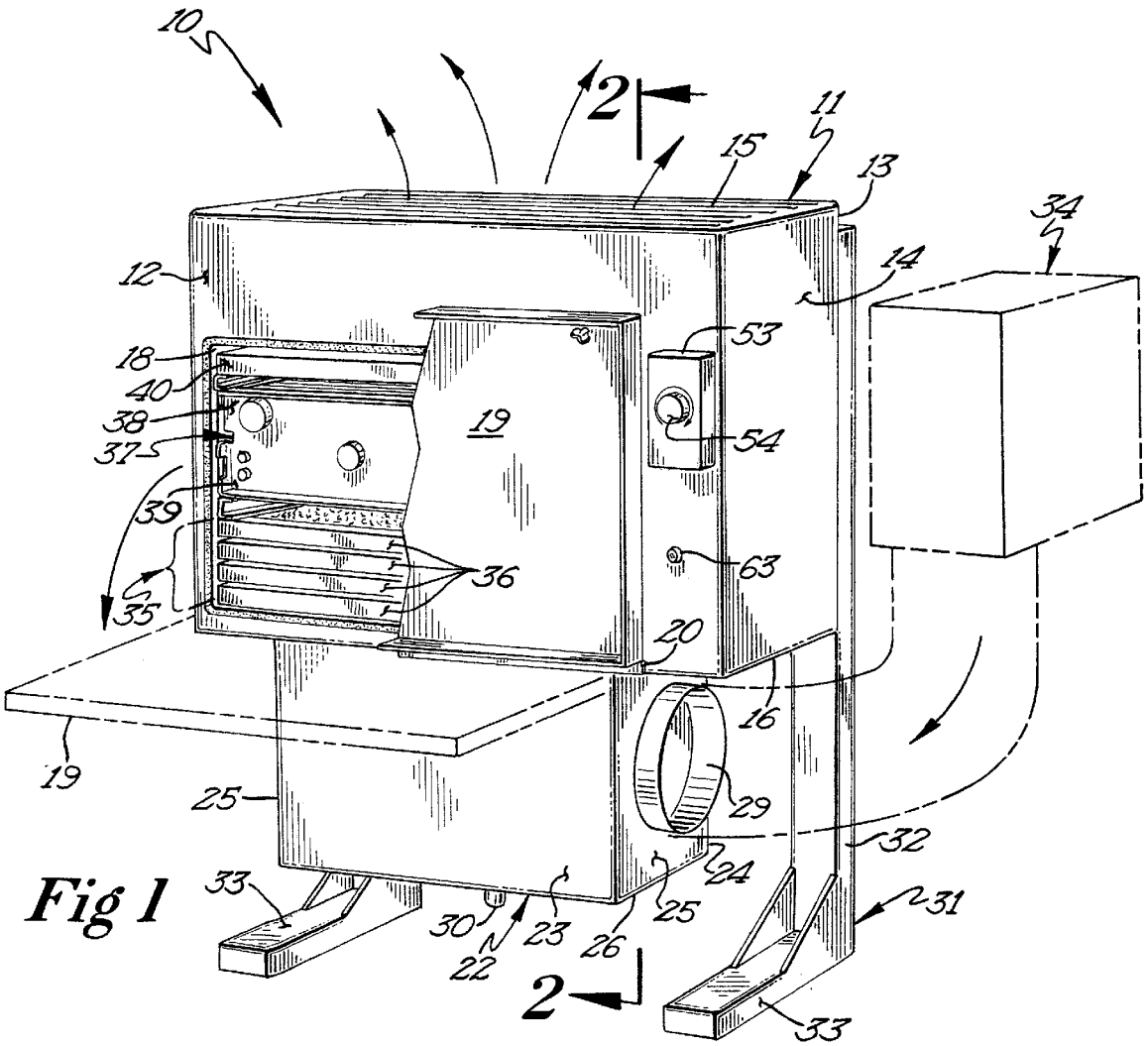
FIG. 1 is front perspective view of the apparatus with the door broken away and illustrating the door in an adjusted position in phantom line configuration.

A blower device 41 is provided and is positioned within the housing 10 above the filter 40 and adjacent the outlet defined by the slotted upper wall 15. The blower device includes an electric motor 42 which is drivingly connected to a rotary impeller 43. Operation of the blower device creates an air scream which entrains droplets, mist and smoke generated by the machine tool and moves these air entrained particles and droplets upwardly through the housing 11. Directional movement of the air stream is indicated by the direction arrows shown in FIGS. 1 and 2.

One of the novel and unique features of the filter apparatus is the circuitry which energizes the collector unit 39 by induced voltage from the ionizing field of the ionizer unit 38 rather than directly energizing the collector unit from the high voltage supply. The high voltage supply delivers voltage of 8200 Vdc to the ionizer and 4150 Vdc to collector units when energizing these units directly. However, when voltages are induced into the collector unit from the ionizer unit, the induced voltage is at 2500 Vdc. It has been found that by operating the collector unit at a low induced voltage and by operating the blower device at a low velocity, the collector unit effectively removes droplets and particles generated by machine tools using water based metal working fluids while avoiding short circuiting within the collector plates.

Figure 3:
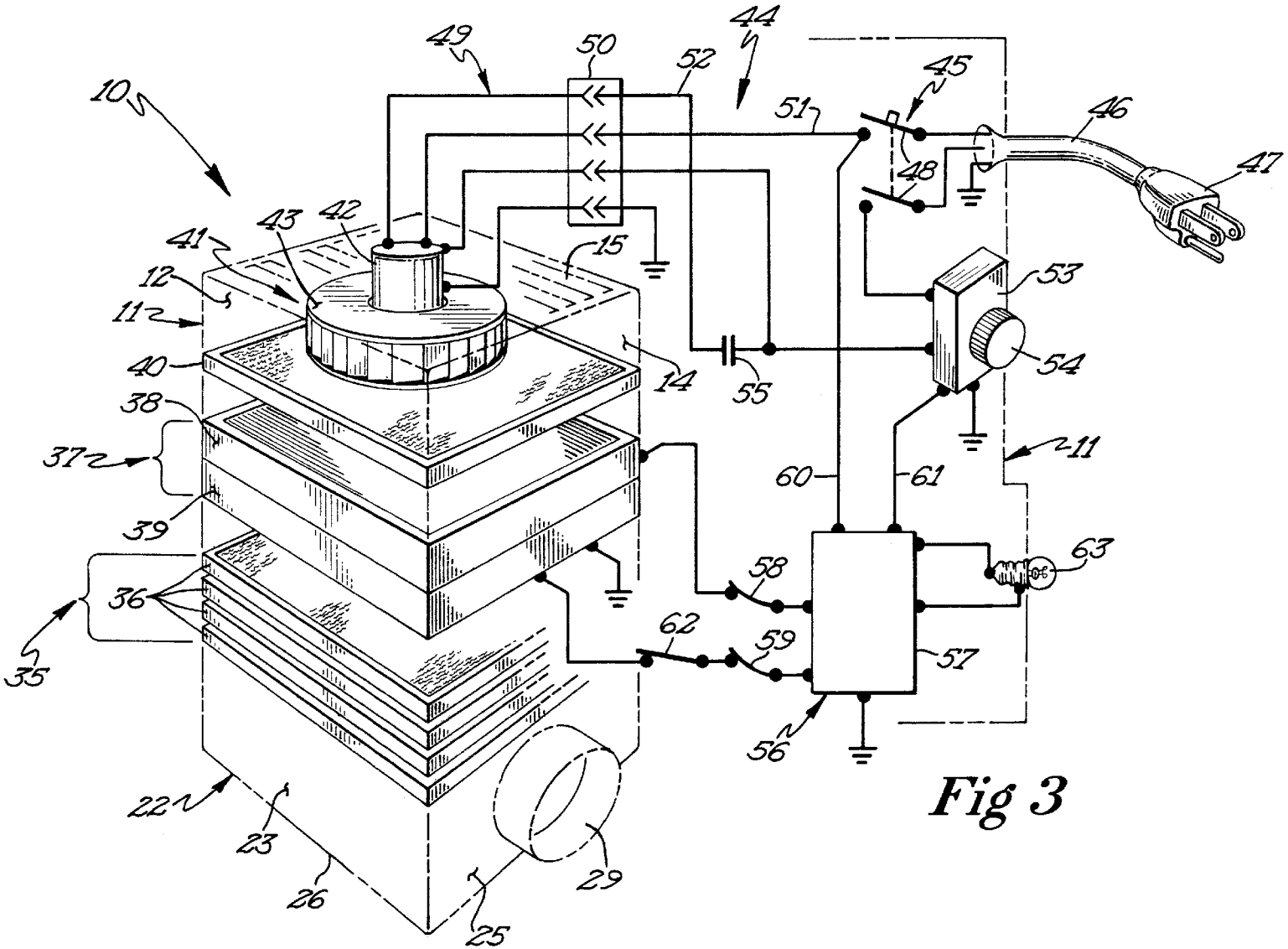
FIG. 3 is a diagrammatic and schematic view of one embodiment of the electrical circuitry for the apparatus.

One embodiment of the novel circuitry 44 is shown in FIG. 3. The circuitry 44 includes a control circuit 45 which is suitably grounded and includes conductors 46 provided with a conventional male bayonet plug 45 for electrical connection to a suitable source of electrical current. The source of electrical current may be a conventional outlet for delivering 115 Vac, 60 Hz. The control circuit includes a pair of interlocked control switches 48 which are disposed in circuit controlling relation with respect to the control circuit.

The circuitry also includes a blower device circuit which is electrically connected via a connector block 50 to the electric motor 42 of the blower device. The blower device circuit is electrically connected to the control circuit by conductor 51. The blower device circuit is provided with a speed control device 53 which comprises a variable potentiometer. The speed control device is electrically connected to the electric motor 42 by a conductor 52. A conventional external capacitor 55 is provided in the blower device circuit for providing smooth start-up operation of the electric motor 42. The speed control 53 which is suitably grounded is provided with a control knob 54 for variously controlling speed of the electric motor and thereby controlling the velocity of the produced air stream.

The circuitry includes a high voltage power supply circuit 56 which is provided with a high voltage supply unit 57. The high voltage power supply is electrically connected to the control circuit by conductor 60 and to the blower device circuit by the conductor 61. The high voltage power supply unit 57 is suitably grounded and is electrically connected to the ionizer unit and collector unit by a spring contacts 58 and 59. The high voltage power supply unit 57 delivers 8200 Vdc to the ionizer and 4150 Vdc to the collector units when the high voltage circuit is energized.

The high voltage power supply circuit is provided with a switch 62 interposed in circuit controlling relation between the high voltage power supply unit 57 and the collector unit 39. When switch 62 is opened, current is interrupted to the collector unit 39 while current is supplied to the ionizer unit 38. The electric field generated by the ionizer unit induces current into the collector unit at a substantially lower voltage (2500 Vdc rather than 4150 Vdc). This induced lower voltage is sufficient to provide adequate collection of the sub-micron ionized particles and droplets. If a petroleum based metal working fluid is being used in the machine tool, then switch 62 will be closed thereby energizing the collector unit 39 at 4150 Vdc.

The high voltage power circuit 56 is provided with an indicator light 63 which is electrically connected to the high voltage power unit 57. When voltage is induced or directed, the light 63 is always on.

Figure 4:
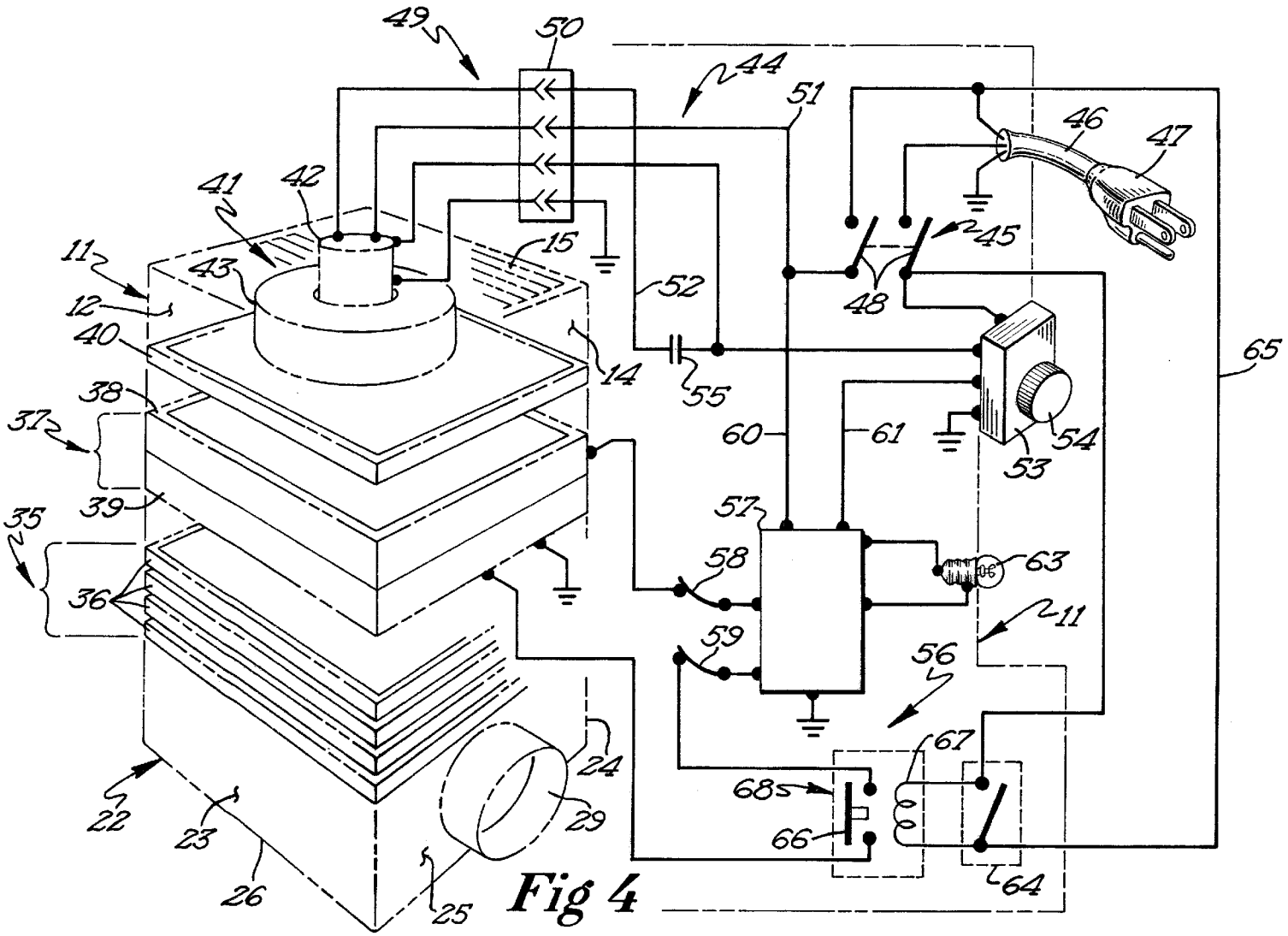
FIG. 4 is a similar diagrammatic and schematic view of that of FIG. 3 but showing another embodiment of the circuitry.

Referring now to FIG. 4, it will be seen that a modified form of the electrical circuitry 44 is schematically shown. The circuitry 44 is the same as that shown in FIG. 3 differing only in the high voltage power supply circuit. The high voltage power supply circuit 56 is provided with a toggle switch 64 electrically connected via a conductor 65 to the control circuit. The high voltage power supply circuit 56 is provided with a high voltage solenoid relay 66 which is disposed in circuit controlling relation with respect to the collector unit 39.

The high voltage relay 66 which is normally closed will open when toggle switch 64 is opened thereby interrupting current to the collector while current will be delivered to the ionizer unit. A lower voltage (2500 Vdc) will be induced into the collector plates of the collector unit 39 in the manner of the embodiment of FIG. 3. The indicator light 63 will be illuminated when toggle switch 64 and the high voltage relay are closed or open.

The high voltage power supply unit 57 may be provided with built-in switch having connections for an external switch. The external switch will not require high voltage but when actuated will allow the collector unit high voltage output to be shut off while allowing the ionizer unit high voltage output to remain on. This circuit will power an external LED to indicate that the ionizer high voltage output is on. The circuit will also power another LED to indicate the collector high voltage is on.

In practice, the filter apparatus 10 will have been mounted on a machine tool or in a convenient location. If the apparatus is mounted directly on the machine tool, the plenum chamber may be attached or the housing may be secured to the machine tool with the inlet opening communicating with the interior working chamber of the machine tool.

If a petroleum based metal working fluid is being used in the machine tool, the circuitry 44 will be energized. The switch 62 in the embodiment of FIG. 3 and the toggle switch 64 in the embodiment of FIG. 4 will be closed. The ionizer unit 38 and the collector unit 39 will both be energized via the high voltage power supply unit 57. Thus the high voltage output (4150 Vdc) of the ionizer unit and collector unit will remain on. The speed control device 53 will be adjusted to a low velocity setting. The blower device is rated at 700 cfm but the blower device setting is within the range of 75–175 cfm, preferably about 125 CFM.

If a water based metal working fluid is being used, then switch 62 in the embodiment of FIG. 3 and switch 64 in the embodiment of FIG. 4 will be opened. Opening the toggle switch 64 opens the normally closed high voltage relay 66. It will therefore be seen that when switch 62 (FIG. 3) and switch 64 (FIG. 4) are opened, electrical current from the high voltage power supply unit 57 to the collector unit will be interrupted. The induced voltage from the ionizing field of the ionizer unit delivers a lower voltage to the collector unit. In the event that a high voltage power supply unit is provided with a built-in electronic switch having an external actuator switch, the actuator switch will be opened when a water based metal working fluid is being used. Conversely, the external actuator switch will be closed if a petroleum based metal working fluid is used.

The blower device setting is very important when the filter apparatus is removing water based metal working mist. A setting within range 75–175 CFM, preferably 125 CFM permits efficient mist collection while virtually eliminating the problem of shorting across the collector plates. Therefore, by using a lower (induced) voltage for the collector unit and a low velocity setting (about 125 CFM) for the blower device, the filter apparatus 10 efficiently removes mist, particles and smoke by the first and second filtration stages while avoiding the attendant problem of shorting across the collector plates. Collected liquid drains back into the machine tool in an even return.

From the foregoing description, it will be seen that a novel apparatus has been provided including an electrostatic precipitator which efficiently removes mist, smoke and particles generated by a machine tool while virtually eliminating the problem of shorting across the collector plates of the collector unit.

What is claimed is:

1. A compact apparatus for collecting and removing smoke, mist and particles generated by machine tools which use water based and petroleum metal working fluids comprising a housing having an inlet and an outlet and being adapted to be connected to a machine tool for receiving mist, smoke and other particles from the machine tool, a blower device within said housing for producing an air stream flowing upward from the inlet through the outlet and entraining smoke, mist and particles generated by the machine tool, a plurality of mechanical filters within said housing adjacent the inlet for removing large mist droplets and particles entrained in the air stream moving through he mechanical filters, an electrostatic precipitator within said housing down stream of the mechanical filters and including an ionizer and a collector, electrical circuitry including a control circuit electrically connected to a source of electrical current and including on-off power switch means, an electrostatic precipitatcr circuit electrically connected said control circuit and to said ionizer and collector and including a high voltage power supply unit for supplying high voltage current to the ionizer and collector, collector switch means in said electrostatic precipitator circuit disposed in circuit controlling relation with the collector and when opened interrupting current to the collector whereby the ionizing field the energized ionizer will induce a lower output voltage to the collector, and a blower circuit electrically connected to the control circuit and to said blower device and including an electrical speed control device disposed in circuit controlling relation with the blower device and being variously adjustable to control the velocity of the blower device, said speed control device being adjusted to operate the speed of the blower device for producing an air stream having a velocity within the range of 75 cfm to 175 cfm when the collector switch means is opened to thereby permit effective mist collection by the collector generated by a water based metal working fluid of a machine tool minimizing short circuiting in the collector.

2. The apparatus as defined in claim 1 wherein said collector switch means comprises a mechanical on-off switch.

3. The apparatus as defined in claim 1 wherein said collector switch means comprises a toggle switch and a normally closed high voltage relay, said high voltage relay being opened to interrupt current flow to said collector when said toggle switch is opened.

4. The apparatus as defined in claim 1 wherein said speed control device in said blower circuit is adjusted such that air stream produced by the blower device has a velocity of approximately 125 cfm.

5. The apparatus as defined in claim 1 wherein the inlet of the housing is located at the lower end of the housing and the outlet is located at the upper end whereby the air stream flows in an upward direction.

6. The apparatus as defined in claim 5 wherein said mechanical filters are horizontally disposed in said housing one above the other, and said electrostatic precipitator being horizontally disposed.

7. The apparatus as defined in claim 6 and a horizontally disposed mechanical filter positioned between the electrostatic precipitator and the blower device.

8. The apparatus as defined in claim 1 wherein said housing has a lower wall and an upper wall, said lower wall having the inlet therein and the upper wall having openings therein defining the outlet, and a plenum chamber secured to the lower wall in communicating relation with the housing inlet and having a plenum inlet opening therein for connection in communicating relation with the machine tool.

* * * * *

UNITED STATES PATENT AND TRADEMARK OFFICE

CERTIFICATE OF CORRECTION

PATENT NO. : 6,428,611 B1 
DATED : August 6, 2002
INVENTOR(S) : Anthony Andolino and John A. Larson It is certified that error appears in the above-identified patent and that said Letters Patent is hereby corrected as shown below:

Title page,
Insert Item [73], Assignee:
-- [73] Assignee: Air Quality Engineering, Inc.,
7140 Northland Drive, North
Minneapolis, MN 55428-1520 --.

Signed and Sealed this

Sixth Day of May, 2003

JAMES E. ROGAN
*Director of the United States Patent and Trademark Office*